US009578949B2

(12) United States Patent
Villarreal et al.

(10) Patent No.: US 9,578,949 B2
(45) Date of Patent: Feb. 28, 2017

(54) DISPENSER WITH THREADED TIP/DISPENSER WITH REMOVABLE CAP

(71) Applicant: HCT Group Holdings Limited, Central (HK)

(72) Inventors: Armando Villarreal, Los Angeles, CA (US); Timothy Thorpe, Santa Monica, CA (US); Adrian C. Apodaca, Daly City, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 14/313,587

(22) Filed: Jun. 24, 2014

(65) Prior Publication Data

US 2014/0376984 A1 Dec. 25, 2014

Related U.S. Application Data

(60) Provisional application No. 61/838,823, filed on Jun. 24, 2013.

(51) Int. Cl.
*A46B 11/00* (2006.01)
*B43K 8/00* (2006.01)
(Continued)

(52) U.S. Cl.
CPC ..... *A45D 34/04* (2013.01); *A45D 2034/002* (2013.01); *A45D 2200/15* (2013.01)

(58) Field of Classification Search
CPC ..... A45D 34/04; B05C 9/14
(Continued)

(56) References Cited

U.S. PATENT DOCUMENTS 3,260,423 A * 7/1966 Fillmore ..... B65D 47/265 222/485
5,307,954 A * 5/1994 Gick ..... B65D 35/22 222/215
(Continued)

FOREIGN PATENT DOCUMENTS

DE 102005012412 * 9/2006 ..... B65D 47/38
GB 2449141 A 11/2008
(Continued)

OTHER PUBLICATIONS

International Search Report mailed Aug. 26, 2014 in corresponding International Application No. PCT/US2014/043880.

*Primary Examiner* — Mark A Laurenzi
*Assistant Examiner* — Thomas M Abebe
(74) *Attorney, Agent, or Firm* — Seager, Tufte & Wickhem LLP

(57) ABSTRACT

A cosmetic applicator includes a container for containing a product to be dispensed and a tip threadably retained on the container. The tip includes an application surface including a thermal member and an opening in the application surface in fluid communication with the container through which the product is dispensed. A cosmetic applicator includes a container containing a product to be dispensed, a dispensing tip disposed on the container having a tip application surface, and a cap selectively engageable with at least one of the container and the dispensing tip to selectively cover the tip application surface. The tip application surface is configured to contact a user's skin to apply the product to be dispensed and an opening in the application surface through which the product to be dispensed is dispensed from the reservoir. The cap includes a cap application surface configured to contact a user's skin to apply the product to be dispensed. At least
(Continued)

one of the dispensing tip or the cap includes a thermal member.

7 Claims, 6 Drawing Sheets

(51) Int. Cl.
*B43K 1/06* (2006.01)
*A46B 11/02* (2006.01)
*A45D 40/26* (2006.01)
*A45D 34/04* (2006.01)
*A45D 34/00* (2006.01)

(58) Field of Classification Search
USPC ..... 401/261–266, 200, 186
See application file for complete search history.

(56) References Cited

U.S. PATENT DOCUMENTS 5,464,122 A * 11/1995 Lifshey ..... A61F 9/0008 222/420
5,577,851 A * 11/1996 Koptis ..... A45D 34/04 401/183
5,927,549 A * 7/1999 Wood ..... B65D 51/285 206/222
6,260,554 B1 * 7/2001 Rowland ..... A24F 1/28 131/173
6,592,282 B2 * 7/2003 Fontanet ..... A45D 34/04 401/188 R
6,796,737 B2 * 9/2004 Ashe ..... B43L 19/0018 215/256
7,004,659 B1 * 2/2006 Goodman ..... B05C 17/002 222/633
7,361,412 B2 * 4/2008 Wang ..... B23K 1/0006 228/245
7,374,361 B1 * 5/2008 Kwon ..... A45D 34/04 401/202
7,883,287 B2 * 2/2011 Thorpe ..... A45D 34/04 401/265
9,266,140 B2 * 2/2016 Gunsell ..... B65D 83/00
2004/0079765 A1 * 4/2004 Gallo, Jr. ..... B65D 47/265 222/153.14
2006/0185758 A1 * 8/2006 Kuo ..... B65D 25/48 141/198
2006/0198686 A1 * 9/2006 Hetzel ..... A45D 34/00 401/47
2006/0285913 A1 * 12/2006 Koptis ..... A45D 40/26 401/205
2007/0210113 A1 * 9/2007 Genosar ..... B05B 11/0043 222/207
2008/0279616 A1 * 11/2008 Thorpe ..... A45D 40/26 401/265
2010/0276441 A1 * 11/2010 Pordy ..... A47G 19/24 222/1
2011/0064512 A1 * 3/2011 Shaw ..... A61L 2/18 401/261
2011/0103879 A1 * 5/2011 Neuner ..... A45D 34/04 401/203
2011/0190672 A1 * 8/2011 Apodaca ..... A61H 1/00 601/17
2012/0104113 A1 * 5/2012 Abfall ..... B05B 11/0037 239/57
2012/0261283 A1 * 10/2012 Anson ..... B65D 47/243 206/221
2013/0189017 A1 * 7/2013 Thiebaut ..... A45D 34/04 401/143
2014/0153612 A1 * 6/2014 Yonekura ..... G01K 7/02 374/179
2014/0161504 A1 * 6/2014 Duquet ..... A45D 34/04 401/147
2014/0234003 A1 * 8/2014 Thorpe ..... A45D 29/16 401/1
2014/0376984 A1 * 12/2014 Villarreal ..... A45D 34/04 401/2
2014/0376985 A1 * 12/2014 Villarreal ..... A45D 34/041 401/2
2015/0230586 A1 * 8/2015 Thorpe ..... A45D 40/26 401/266

FOREIGN PATENT DOCUMENTS

WO WO 2005042240 A2 * 5/2005 ..... B23K 1/0006
WO WO 2012032148 A1 * 3/2012 ..... A45D 34/04
WO 2013/017801 A1 2/2013
WO WO 2013017801 A1 * 2/2013 ..... A45D 34/04

* cited by examiner

DISPENSER WITH THREADED TIP/DISPENSER WITH REMOVABLE CAP

CROSS REFERENCE TO RELATED APPLICATIONS

This application claims priority to U.S. Provisional Patent Application No. 61/838,823, filed on Jun. 24, 2013, which is hereby incorporated by reference in its entirety herein.

BACKGROUND

Devices for dispensing cosmetics and medicinal products are known. One conventional configuration includes an outer tubular shell or housing having a reservoir containing a product and an applicator tip disposed on a distal end of the shell or housing. In the medical industry, applicators are used for applying products such as ointments to portions of the body. In the cosmetic and personal care industries, applicators may be used to apply lipstick, lip balm, creams, and lotions to portions of a user's body.

In many cases, the medicinal and cosmetic products include skincare substances, such as aloe or lanolin, that provide a healing or therapeutic effect to heal damaged skin or that maintain healthy skin. In addition, these products may include therapeutic substances, such as topical anesthetics, analgesics, fragrances, or menthol.

Conventional application of conventional products to the skin is sufficient in many instances, but in other instances it also is desirable to provide a thermal treatment to the skin contemporaneously with application of the product. For example, it may be desirable to apply a cooling or heating sensation via the applicator. In some instances, it may be desirable to have the applicator provide either a heating or cooling sensation, which may offset or enhance a thermal sensation from the product or be completely independent of the product.

SUMMARY

This summary is provided to introduce simplified concepts of dispensers with thermal members, which are further described below in the Detailed Description. This summary is not intended to identify essential features of the claimed subject matter, nor is it intended for use in determining the scope of the claimed subject matter.

This disclosure describes improved tips, such as for cosmetic applicators, that include a thermal storage member that is capable of storing and retaining thermal energy. The improved tips according to this disclosure are generally useful to allow a product to be applied locally or topically to a selected area of a user's skin, while providing a thermal effect.

In one implementation, a cosmetic applicator includes a container for containing a product to be dispensed and a tip threadably retained on the container. The tip includes an application surface including a thermal member and an opening in the application surface in fluid communication with the container through which the product is dispensed.

In some implementations, the container has a threaded neck configured to cooperate with tip threads formed on a skirt depending from the tip. The tip may be formed integrally with the skirt or the skirt may be separate from the remainder of the tip.

In other implementations, a cosmetic applicator includes a container for containing a product to be dispensed and a thermal tip. The container includes a sidewall, a closed end, an open end, and a container threaded portion proximate the open end. The thermal tip includes a tip threaded portion configured to engage the container threaded portion, an application surface, and an opening in the application surface in fluid communication with the container.

In one implementation, a cosmetic applicator includes a container containing a product to be dispensed, a dispensing tip disposed on the container having a tip application surface, and a cap selectively engageable with at least one of the container and the dispensing tip to selectively cover the tip application surface. The tip application surface is configured to contact a user's skin to apply the product to be dispensed and an opening in the application surface through which the product to be dispensed is dispensed from the reservoir. The cap includes a cap application surface configured to contact a user's skin to apply the product to be dispensed. At least one of the dispensing tip or the cap includes a thermal member.

A better understanding of these and other implementations will be better understood with reference to the attached Figures and the following Detailed Description, in which features of this disclosure are illustrated and described.

BRIEF DESCRIPTION OF THE DRAWINGS

The figures are described in more detail below in the Detailed Description section of this application. In the figures the left-most digit of a reference number identifies the figure in which the reference number first appears. The use of the same reference numbers in different figures indicates similar or identical items.

DETAILED DESCRIPTION

Figure 1A:
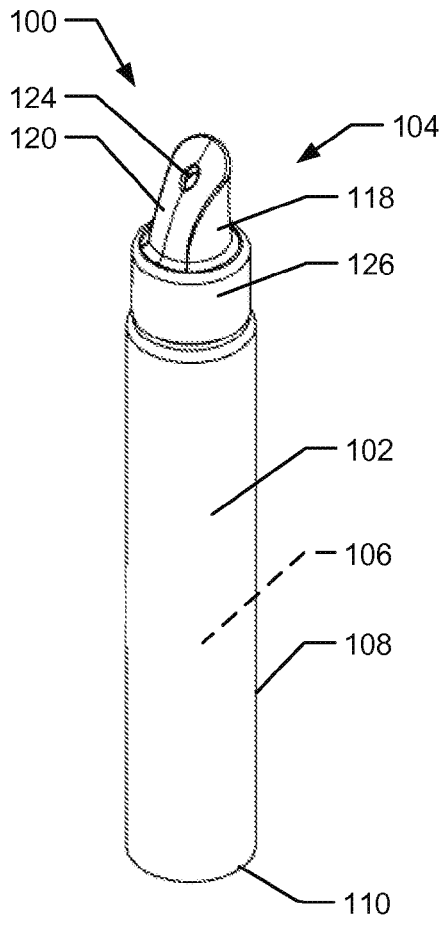
FIG. 1A is a perspective view of an illustrative dispenser having an applicator tip according to one implementation.

This disclosure relates generally to an applicator that includes a container containing a product to be dispensed and a dispensing tip threadably retained on the container. The dispensing tip incorporates a thermal member that stores and/or transmits a level of thermal energy. The thermal member is intended for contacting a user's skin, to provide a thermal sensation to the user.

This disclosure relates generally to an applicator that includes a dispensing portion and a separable cap. The dispensing portion includes a container containing a product to be dispensed and an attached dispensing tip. Both the dispensing tip and the cap include an application surface. One or both of the application surfaces may include a thermal material that stores and/or transmits a level of thermal energy. The thermal material(s) is/are intended for contacting a user's skin, to provide a thermal sensation to the user.

In one implementation, a product is dispensed from a reservoir in the container through an opening in the dispenser tip for application to a user's skin. The tip application surface contacts the user's skin during or after dispensing of the product, and the user may cause the application face to contact an even larger area of skin, for example, when the user causes the application face to spread the product on his/her skin. By virtue of the thermal member's thermal properties, thermal energy is applied to or removed from the user's skin for heating or cooling during application. Contact of the thermal member with the product may also result in transfer of heat to or from the product. Accordingly, in some embodiments the user will feel a thermal sensation (warm or cool depending on the thermal energy in the thermal member), in other embodiments, the product will be warmed or cooled, and in still other embodiments both the product and user's skin will be thermally effected by the thermal member.

The thermal member includes a material capable of retaining and/or transferring heat or cold. Accordingly, in some embodiments, the thermal member may be made in whole or in part of a material having a thermal conductivity above a threshold. For instance, in some embodiments, to retain and transfer sufficient heat or cold the thermal member may be made of a material having a thermal conductivity of at least 1 watt/meter-kelvin. In other implementations, thermal conductivities greater than about 5.0 watt/meter-kelvin are desirable and, in still further implementations, thermal conductivities greater than about 20.0 watt/meter-kelvin are desirable.

Other material properties may also describe aspects of thermal members. For instance, heat capacity of the material may also be relevant. In some embodiments, the material from which the thermal member is made in whole or in part may also have a heat capacity of at most about 1.1 kilojoules/kilogram-kelvin. In other instances, heat capacities lower than about 0.75 KJ/kg-K may be desirable. Moreover, thermal effusivity, which factors in a material's thermal conductivity, heat capacity, and density may be of interest. Generally, the higher the effusivity, the greater will be the heat transfer to or from the user's skin. In some embodiments materials having a thermal effusivity higher than about 150.0 $J\text{-}m^{-2}\text{-}K^{-1}\text{-}s^{-1/2}$ may be preferred.

In some embodiments, the heat or cold retained (for subsequent transfer) by the thermal member results from exposure to the ambient environment. That is, in some embodiments, after transfer of the heat or cold from the thermal member to the user's skin, the thermal member regenerates, i.e., reheats or re-cools, merely by being exposed to the ambient environment. For the purpose of this application, the term ambient environment refers to a comfortable indoor room temperature of between about 20° C. (68° F.) and about 25° C. (77° F.). In these embodiments and under the noted conditions, no additional heating or cooling may be required. In other embodiments, it may be desirable to introduce the thermal member to a higher or lower temperature than ambient to "charge" the thermal member with the desired thermal energy (or lack thereof).

In implementations of this disclosure, the thermal member may include one or more of metal, stone material, and ceramic, or composites thereof, whether natural or synthetic, capable of retaining and transferring heat or cold for a period of time.

Some example metals that may be used in embodiments of this disclosure include, without limitation, stainless steel, aluminum, zinc, magnesium, tin, nickel, titanium, steel, tin, copper, brass, platinum, gold, and silver, and alloys, such as ZAMAK.

Stone materials that may be used in embodiments of this disclosure include, without limitation, any stone, rock, mineral, ore, gemstone, imitation gemstone, glass stone (including naturally occurring and man-made forms of glass), volcanic stone, coral stone, metallic stone or ore, magnetic stone, concrete, or composites thereof, whether synthetic or naturally occurring.

Figure 1B:
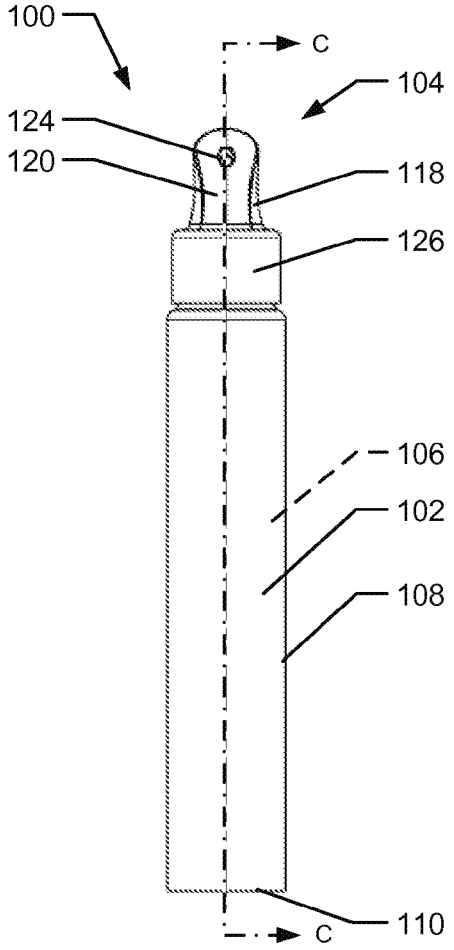
FIG. 1B is a front view of the dispenser illustrated in FIG. 1A.
Figure 1C:
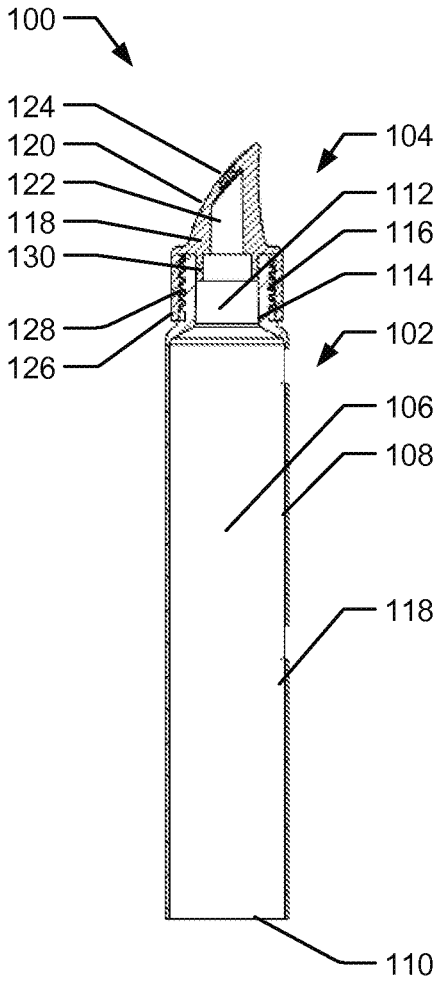
FIG. 1C is a cross-sectional view of the dispenser illustrated in FIG. 1A, taken along section line C-C in FIG. 1B.

FIGS. 1A-1C illustrate an applicator 100 according to a first implementation. The applicator 100 generally includes a container 102 and a dispensing tip 104 disposed on the container 102. The container 102 is adapted to contain a product (not shown) to be dispensed from the applicator 100. Specifically, the container 102 defines a reservoir 106 for containing the product. In the illustrated embodiment, the container 102 has a continuous sidewall 108 having a closed end 110 and an opposite, open end 112. In FIGS. 1A-1C, the container 102 is illustrated as being a cylindrical tube, which in operation is squeezed to express the product out the open end 112. The container may take any other form or shape, including but not limited to tubes, bottles, and tottles. Moreover, product in the container need not be dispensed by squeezing. In some implementations, the container may include a pump or other mechanism to aid in dispensing the product, for example.

The illustrated container 102 also includes a neck 114 arranged proximate the open end 112. As illustrated, the neck 114 has an inner diameter smaller than an inner diameter of the sidewall 108. Also in this embodiment, the outer diameter of the neck 114 is smaller than an outer diameter (and the inner diameter) of the sidewall 108. Accordingly, the neck 114 is stepped radially inwardly relative to the sidewall 108. One or more threads 116 are formed on the neck 114, thereby forming a threaded neck in the embodiment of FIGS. 1A-1C. In other embodiments, the neck may merely be an extension of the sidewall 108, having the same inner diameter and/or outer diameter as the sidewall 108 and in still further embodiments the neck (that is, the outer diameter of the neck or both of the inner and outer diameters of the neck) may be larger than the sidewall 108.

The dispensing tip 104 generally includes a body 118 and an application surface 120. The application surface 120 may be only a portion of the tip 104, or it may include the entirety of the tip 104. As more of the tip comprises the application surface, the size of the application surface will be relatively larger. The body 118 defines a product delivery passageway 122 in fluid communication with an opening 124 extending through the application face 120. When the dispensing tip 104 is disposed on the container, the product delivery passageway 122 provides a conduit between the reservoir 106 and the opening 124 in the application face 120.

In FIGS. 1A-1C, a skirt 126 depends downwardly from the body 118 of the dispensing tip 104. One or more tip threads 128 are formed on an inner surface of the skirt 126. The tip threads 128 cooperate with the container threads 116 to attach the tip 104 to the container 102. When attached, product in the container is free to exit the opening 124 via the product delivery passageway 122, as described above.

As best illustrated in FIG. 1C, a sealing member 130 also is provided on the body 118. The sealing member 130 is an annular protrusion spaced radially inwardly from the skirt 126. When the dispensing tip 104 is disposed on the container 110, the sealing member 130 preferably contacts an inner surface of the neck 114 proximate the open end 112 of the container 102 to provide a seal therewith. In this manner, product leaving the container is directed entirely into the product delivery passageway 122, and will not leak out between the dispensing tip 104 and the container 10. Moreover, in the illustrated embodiment, the neck of the container is sandwiched between the skirt and the sealing member, which provides rigidity to the neck of the tube and prevents the threads on the neck from deforming inwardly when the tip is screwed firmly onto the container.

In other implementations, the sealing member 130 may be disposed to contact a different surface of the container 102. For example, the sealing member 130 may depend a shorter distance axially and be positioned to contact the top of the neck 114 at the open end 112. A combination of the two sealing members just described may also be implemented. In still further embodiments, a gasketing mechanism such as an o-ring or a sealant such as sealing tape may be provided on one or both of the tip threads 128 and the container threads 116. Either of these may obviate the need for the sealing member 130.

In the embodiments illustrated in FIGS. 1A-1C, the dispensing tip is formed as a unitary member. In other embodiments, the dispensing tip may not be unitary. For example, in the embodiment illustrated in FIG. 2, a dispensing tip 202 similar to the dispensing tip 104 described above, includes a body 204 and a skirt 206 separate from the body 204. The body 204 has an application surface 208 and defines a product delivery passageway 210 in fluid communication with an opening 212 in the application surface 208. An annular protrusion 214 extends radially outwardly from the body 204, proximate a bottom of the body 204. The skirt 206 has a thread or threads 216 formed on an inner surface thereof and includes an annular flange 218 that depends radially inwardly from the skirt, proximate a top of the skirt, i.e., above the threads 216. The annular flange 218 of the skirt 206 defines an opening having a diameter larger than an outer diameter of the body 204, except for the annular protrusion 214 of the body. Specifically, the diameter of the opening defined by the annular flange 218 is smaller than an outer diameter of the annular protrusion 214 of the body 204. In this manner, the skirt 206 may be placed over the body 204 such that the annular flange 218 of the skirt 206 rests on the annular protrusion 214 of the body 204. Threadably engaging the skirt 206 on a container (via the threads 216) retains the body 204 on the container.

Figure 2:
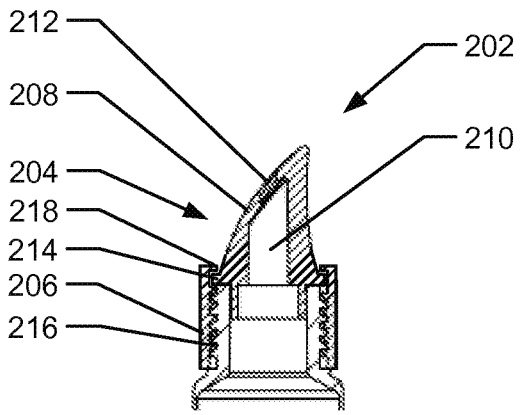
FIG. 2 is a cross-sectional view of an applicator tip according to an alternative implementation.

In the embodiment of FIG. 2, the body 204 may rotate relative to the skirt. As a result, for example, the tip may be placed in any rotational position relative to the container. If a component of the applicator, such as the container, has a non-symmetrical shape, the user may rotate the tip to allow the user to hold the container in any comfortable position. Additionally, the skirt 206 and the body 204 in this example may be more readily formed of different materials. In this manner, for example, only the body 204 may include the thermal material, as opposed to an embodiment in which the entire tip (body and skirt) is formed of a uniform, thermal material. Of course, unitary tips, like the thermal tip 104 described above, may also be formed of multiple different materials, for example, by a co-mold or over-molding process.

In the foregoing illustrative embodiments, the dispensing tips 104, 202 include a thermal material. In one example, a thermal material is provided as an aggregate or powder that is formed into the shape of the dispensing tip 104 or the body 204 of the dispensing tip 202. The aggregate or powder may be molded or compressed into the desirable shape, for example. An aggregate or powder may also be entrained in a polymer, which may be more readily molded using conventional techniques, such as injection molding. In other embodiments, the thermal member may be liquefied, e.g., by heating, and then cast or molded into the desired shape. In yet other embodiments, the dispensing tip 104 and the body 204 (and the skirt 206 in some implementations) may be machined from a blank comprising the thermal material.

In alternate implementations, the thermal material may be provided as a separate (from the body) thermal member that is secured to the body after formation. In these implementations, the thermal member preferably is arranged on the body to provide the application face.

Figure 3:
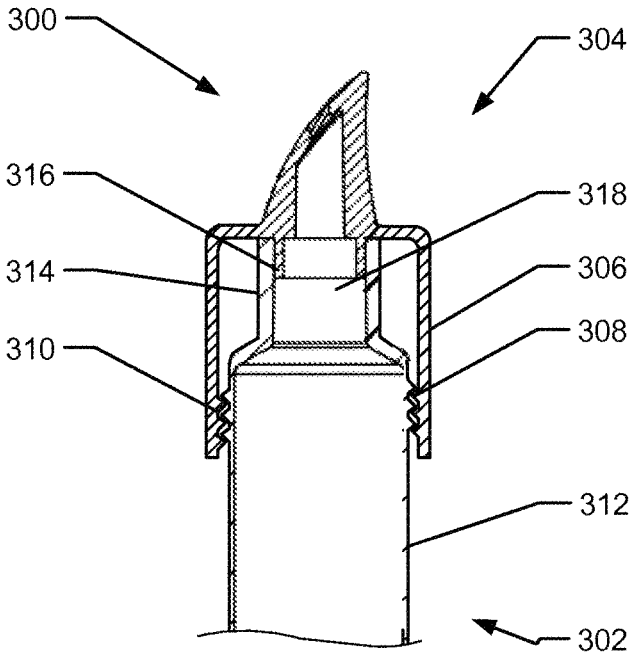
FIG. 3 is a cross-sectional view of an illustrative dispenser according to an alternative implementation.
Figure 4A:
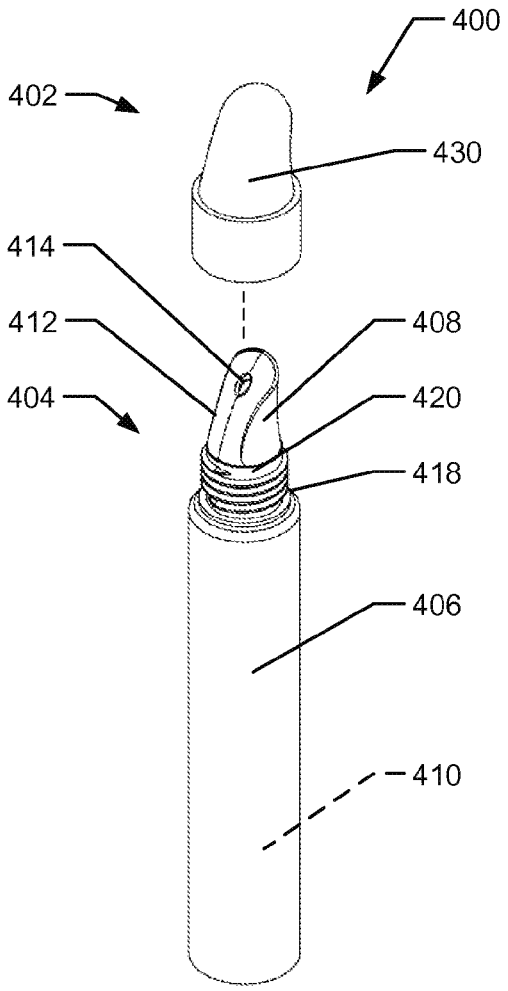
FIG. 4A is an exploded perspective view of an illustrative dispenser and removable cap according to an alternative implementation.
Figure 4B:
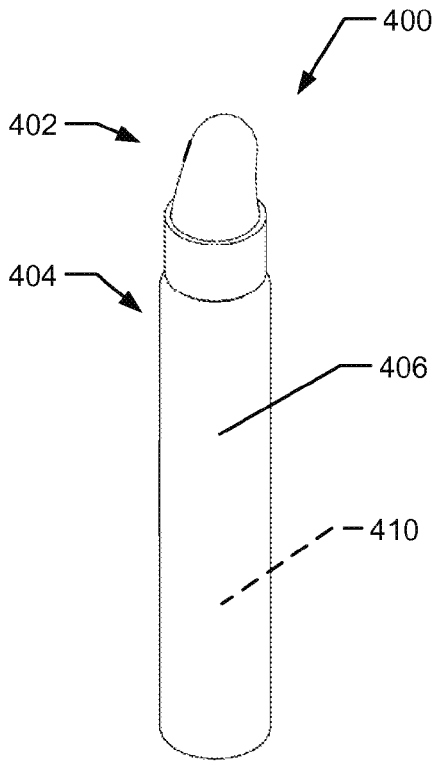
FIG. 4B is a perspective view of the dispenser of FIG. 4A in which the removable cap is retained on the container.
Figure 4C:
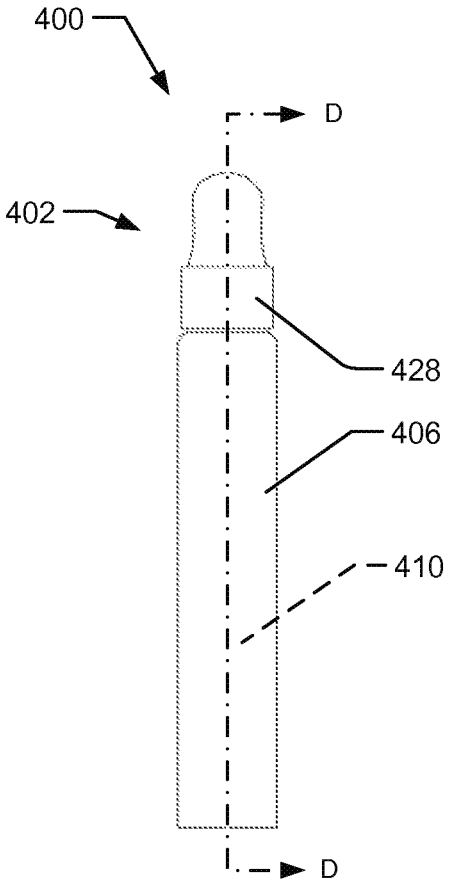
FIG. 4C is a front elevation view of the dispenser of FIG. 4A in which the removable cap is retained on the container.
Figure 4D:
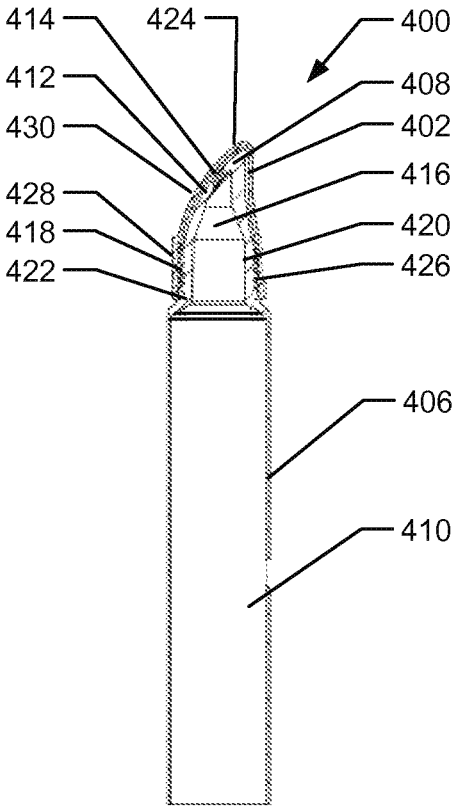
FIG. 4D is a cross-sectional view of the dispenser illustrated in FIGS. 4A-4C, taken along section line D-D in FIG. 4C.

FIG. 3 is a cross-sectional view of another implementation. Like the embodiment illustrated in FIGS. 1A-1C, a dispenser 300 illustrated in FIG. 3 includes a container 302 and a tip 304 threadably engaged on the container 302. In this embodiment, a skirt 306 has a larger diameter and extends further in the longitudinal direction than the skirt 126 discussed above. As in the earlier embodiments, tip threads 308 are provided on the inner surface of the skirt 306. In this implementation, though, container threads 310 are formed on a sidewall 312 of the container 302, instead of on the neck 314. Accordingly, the tip is threaded onto the container by engaging the tip threads 308 with the container threads 310 on the container sidewall 312, instead of on the neck 314.

FIG. 3 also shows a seal 316 for contacting an inner surface of the neck, similar to the seal 130 described above. However, the seal 316 may not be necessary. In further implementations, the seal 316 may take a different form or shape, including one of the forms or shapes discussed above as an alternative implementation to the container illustrated in FIGS. 1A-1C.

In another implementation, the container 302 may not have a stepped neck 314. Instead, the container 302 may have a uniform sidewall along its entire length, with the tip threads 308 engaging container threads 310 proximate the open end 318 of the container 302. In such an implementation, the skirt 306 may not need be any longer in the longitudinal direction than in the embodiment shown in FIGS. 1A-1C, i.e., because the threads are not axially spaced from the open end 318 to accommodate the length of the neck 314. In such an embodiment, the seal 316 (if present) may have a diameter sized to fit within and/or seal against an inner surface of the container 302.

In the embodiments illustrated in FIGS. 1A-1C, 2, and 3, a tip is shown as being threaded onto a container to secure it thereto. That is, in those embodiments the threads form engagement portions for securing the cap to the container. The tip and the container may instead be otherwise engaged, such as via a snap fit, a press fit, welding, or adhesive. As will be appreciated with the benefit of this disclosure, alternative engagement features or portions may be provided on the tip and/or the container to promote different, i.e., non-threaded, types of engagement.

FIGS. 4A-4D illustrate another cosmetic applicator 400. The applicator 400 includes a cap 402 threadably engageable with a dispensing component 404. The dispensing component 404 includes a container 406 and a tip 408 at a distal end of the container 406.

The dispensing component 404 is similar to the dispenser 100, 300 described in previous embodiments. For example, the container 406 defines a reservoir 410 for containing a product to be dispensed and the tip 402 includes an application surface 412. An opening 414 is formed through the application surface 412, in fluid communication with a product delivery passageway 416, which in turn is in fluid communication with the reservoir 410. Product contained in the reservoir is expressed from the dispenser 400 through the opening 414, via the product delivery passageway 416, and the user can spread the product using the application surface 412.

In some instances, the dispensing component 402 also includes dispenser threads 418. In the illustrated embodiment the threads 418 are formed on a neck 420 disposed between the tip 408 and the container 406. In other embodiments, the threads 418 may be formed on the container 406, on the tip 408, or on both the container 406 and the tip 408. In still further embodiments, a separate member may be provided on one or more of the container 406, the neck 420, or the tip 408, with the threads formed on that member. For example, the threads may be provided on a separate collar that is secured to the dispensing component 404.

In the illustrated embodiment, the tip 408 is formed integrally with the container 406 to form the dispensing component 404. In other implementations, the tip 408 may be formed separately from the container 406 and later secured to the container using one or more conventional securing instrumentalities and/or processes. For example, the tip may be welded, adhered, heat sealed, or otherwise secured to the container. In other embodiments, the tip 408 may be formed separately from the container, for subsequent engagement with the container, as in the embodiments described above. Other means of securing the tip 408 to the container 406, such as a snap fit and a press fit, may also be appreciated by those having ordinary skill in the art, with the benefit of this disclosure.

The cap 402 defines an open bottom 422 sized to receive therein a portion of the dispensing component 404. The cap further includes a closed top 424 and one or more cap threads 426 on an inner surface, proximate the open bottom 422. In the illustrated embodiment, a skirt 428 is formed proximate the opening 422, and the threads 426 are formed on an inner surface of the skirt 428. In alternative embodiments, the skirt 428 need not be provided, as the threads 426 may be formed directly on any inner surface of the cap 402. The cap threads 426 are configured and disposed to cooperate with the dispenser threads 418, to allow for threaded engagement of the cap 402 with the dispensing portion 404.

The cap 402 also includes a cap application surface 430 on an outer surface thereof. Although in the illustrated embodiment the cap application surface 430 is the outer surface of the cap 402 (in some implementations including the skirt 428), in other implementations the cap application surface 430 may be provided on a separate member that is affixed to or otherwise retained on the cap 402. The cap application surface 430 is illustrated as being a contoured surface, generally mimicking the contour of the tip application surface 412. In other implementations, the cap application surface 430 may take any shape or contour.

In use, the cap 402 may be removed from the dispensing component 404 and product may be expressed from the dispensing component 404 through the opening 414 onto a surface to be treated, e.g., the user's skin. The product may then be spread on a larger area of the surface to be treated using one of the tip application surface 412 and the cap application surface 430. When the tip application surface 412 is used, the cap 402 remains removed from the dispensing component. When the cap application surface is to be used, it may be reattached to the dispensing component, or it may be used directly, i.e., without reattachment. When the applicator 400 is not in use, the cap 402 may be threaded onto the dispensing component 404 to cover the opening 414.

In various implementations, the tip application surface 412 and the cap application surface 430 have different properties. For example, one of the application surfaces 412, 430 may include a thermal material. In other implementations, both application surfaces may have thermal materials, but with different properties. For example, one may have a warming effect, whereas the other has a cooling effect. In still other implementations, the separability of the cap enables the user to cool or warm a thermal material comprising the cap application surface using an external cooling or heating source. For instance, the cap may be placed in a refrigerator or freezer until it is ready for use, which may enable the cap application surface to have a more intense cooling sensation than could be accomplished through the use of a material (or the same material) that achieves its cooling sensation merely as a result of cooling in the ambient environment.

The application surfaces 412, 430 can be different in other ways, as well. In conjunction with, or separate from, the thermal materials, the application surfaces 412, 430 may have different contours, e.g., one flat and one contoured, and/or they may have different textures, e.g., one smooth and one bumped. Providing the application surfaces 412, 430 with different properties allows a user a greater range of selection. In some implementations, the different application surfaces 412, 430 may complement each other. For example, one of the application surfaces 412, 430 may provide a rougher or abrasive surface that exfoliates a user's skin, whereas the other surface is smooth for application of the product on the exfoliated skin. As should also be appreciated, in some implementations, the "application" surface may in fact be used by a user without any product. For instance, in the example above, the exfoliation may be achieved in the absence of product, with the product intended to be applied to the exfoliated skin.

Figure 5:
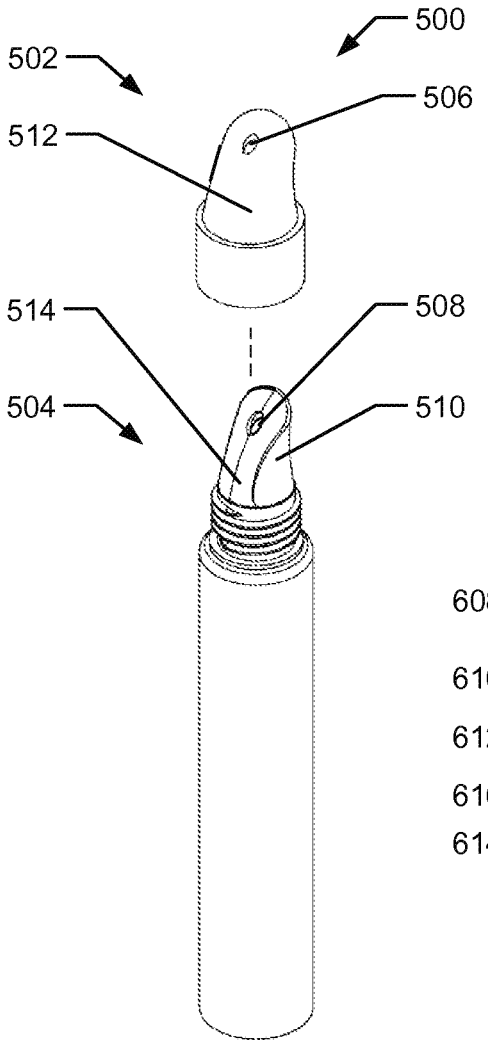
FIG. 5 is an exploded perspective view of an illustrative dispenser and removable cap according to an alternative implementation.

FIG. 5 shows another applicator 500 similar to the applicator 400. The applicator 500 generally includes a cap 502 threadably receivable on a dispensing portion 504. Unlike the cap 402 described above, however, the cap 502 has an opening 506 formed therethrough. The opening 506 is aligned with an opening 508 in a tip 510 of the dispensing portion 504 to allow passage of dispensed product through the cap 502. In this manner, a user can dispense a product from the dispensing portion 504 with the cap 502 engaged and apply the product using a cap application surface 512. Or, the user can remove the cap 502 and dispense the product through the opening 508 and apply the dispensed product using a tip application surface 514.

Although not illustrated, a protrusion may be provided inside the cap 502, circumscribing the opening 506. When the cap 502 is secured to the dispensing portion 504, the protrusion nests or is otherwise received in the opening 508, preferably in substantially sealing engagement, to ensure that product dispensed when the cap 502 is secured to the dispensing portion 504 is directed out the opening 506, instead of seeping into a space between the cap 502 and the tip 510. As should be appreciated, in this implementation, the openings 506, 508 may be positioned on a longitudinal axis of the applicator, i.e., so the openings are aligned regardless of the rotational position of the cap 502 relative to the tip 510. While also not shown, the applicator 500 may additionally include an overcap to cover and seal the opening 506 in the cap 502 during non-use.

As noted above, the tip 408, 510 and the cap 402, 502 may take any number of contours and compositions. In some implementations, the respective shapes of the tip 408, 510 and the cap 402, 502 may be such that the cap 402, 502 is free to rotate over the tip 408, 510 during engagement on and removal from the dispensing portion 404, 504. Alternatively, instead of the cap being configured for threaded engagement with the dispensing portion as shown, in other embodiments the cap 402, 502 may be removably attachable to the dispensing portion 404, 504 by a snap fit, press fit, or any other removable attachment mechanism. In yet another threaded example, the tip 408, 510 may be fabricated such that it is rotatable relative to the remainder of the dispensing portion 404, 504. In this manner, the tip 408, 510 rotates with the cap 402, 502 as it is threaded onto (and removed from) the dispensing portion.

Figure 6:
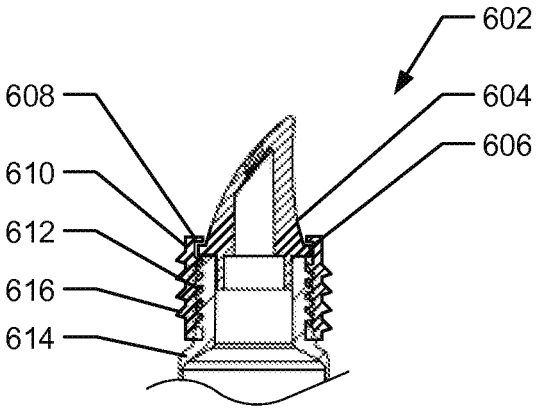
FIG. 6 is a cross-sectional view of an illustrative dispenser tip configured to receive a removable cap, according to another implementation.

An example of a rotatable tip 602 is illustrated in the cross-sectional depiction of FIG. 6. The design of FIG. 6 is similar to that of FIG. 2. It is a two-piece design in which a tip portion 604 has an annular flange 606 that is contacted by an annular protrusion 608 of a skirt 610 that includes threads 612 for attaching the tip 602 to a container 614. Different from the embodiment of FIG. 2, however, is the presence of external threads 616. As illustrated, the threads 616 are formed on the outside of the skirt 610. The threads 616 are provided to cooperate with a thread or threads on an inner surface of a cap (not shown). In such an implementations, an inner surface of the cap has a size and contour that cooperates with an outer surface of the tip 602 (and more particularly an outer surface of the body 604 of the tip 602 in the illustrated embodiment) such that the cap has a proper orientation on the tip 602. During threadable engagement, the cap orients the tip 602 relative thereto, such that continued tightening of the cap causes the tip 602 to rotate in the predetermined orientation therewith, both relative to the skirt 610.

Although the implementations of FIG. 6 shows that the tip 602 is threadably engaged with a container, such is not required. The tip 640 may be attached to the container using any known mechanism or methodology, including but not limited to, welding, molding, press fit, and snap fit.

Alternatives also are contemplated. In one alternative to the embodiment of FIG. 6, the threads 616 may not be formed on the tip 602, but instead may be formed on an outer surface of the container to which the tip 602 is attached. Other modifications also may be appreciated by those having skill in the art in view of this disclosure.

Some embodiments provide a cosmetic applicator comprising a container for containing a cosmetic product to be dispensed; a tip threadably retained on the container, the tip comprising an application surface including a thermal member and an opening in the application surface in fluid communication with the container through which to dispense the product. In some embodiments, the container comprises a threaded neck proximate an open end of the container and the tip comprises at least one tip thread adapted to threadably engage the threaded neck. In some embodiments, the threaded neck comprises one or more threads on an external surface of the neck. In some embodiments, the at least one tip thread is formed on a skirt depending from the tip. In some embodiments, the application surface is formed on both the tip and the skirt. In some instances, the skirt is formed integrally with the tip. In some embodiments, the threaded neck is disposed radially inwardly from an outer surface of a sidewall of the container. In some embodiments, the thermal member comprises at least one of metal, ceramic, and a stone material. In some embodiments, the thermal member has a thermal conductivity of at least 1 watt/meter-kelvin. In some embodiments, the thermal member has a heat capacity of at most about 1.1 kilojoules/kilogram-kelvin. In some embodiments, the tip further comprises a sealing member contacting the container when the tip is threadably retained on the container. In some embodiments, the container comprises a sidewall and one or more threads are disposed on an external surface of the sidewall. Some embodiments further comprise a cap selectively securable to one of the container and the tip to selectively cover and expose the opening in the application face. In some embodiments, the cap is selectively securable to one of the container and the tip using at least one of a threaded engagement, a snap fit, and a friction fit. In some instances, the cap further comprises a dispensing hole. In some instances, the dispensing hole in the cap aligns with the opening in the application surface. In some cases, the skirt is separate from the tip.

Some embodiments provide a cosmetic applicator comprising a container for containing a product to be dispensed, the container comprising: a sidewall; a closed end; an open end; and a container attachment portion proximate the open end; and a thermal tip comprising: a tip attachment portion configured to fit over and attach to the container attachment portion; an application surface for applying the product to a surface; and an opening in the application surface in fluid communication with the container. In some embodiments, the thermal tip further comprises a skirt depending from the tip, the skirt being configured to fit over the container. In some embodiments, the tip engagement portion is formed on an inner surface of the skirt. In some embodiments, the container attachment portion and the tip attachment portion are configured to attach via at least one of a threaded engagement, a snap fit engagement, a press fit engagement, and a welding engagement. In some embodiments, the thermal tip further comprises a product delivery passageway in fluid communication with the opening in the application surface and the container. In some embodiments, the container comprises a neck proximate the open end and the container engagement portion is formed on the neck. In some embodiments, the container engagement portion is formed on the sidewall. In some embodiments, the thermal tip comprises a thermal member. In some embodiments, the thermal member comprises one or more of a ceramic, a metal, and a stone material. In some embodiments, the thermal member has a thermal conductivity of at least 1 watt/meter-kelvin. In some embodiments, the thermal member has a heat capacity of at most about 1.1 kilojoules/kilogram-kelvin.

Some embodiments provide a cosmetic applicator comprising a container containing a product to be dispensed; a dispensing tip disposed on the container, the tip comprising a tip application surface configured to contact a user's skin to apply the product to be dispensed and an opening in the application surface through which the product is to be dispensed from the reservoir; and a cap selectively engagable with at least one of the container or the dispensing tip to selectively cover the tip application surface, the cap comprising a cap application surface configured to contact a user's skin to apply the product to be dispensed, wherein at least one of the dispensing tip or the cap includes a thermal member. In some embodiments, the thermal member comprises one or more of a ceramic, a metal, and a stone material. In some embodiments, the thermal member has a thermal conductivity of at least 1 watt/meter-kelvin. In some embodiments, the thermal member has a heat capacity of at most about 1.1 kilojoules/kilogram-kelvin. In some embodiments, the cap comprises a dispensing hole disposed therein. In some instances, the dispensing hole of the cap is substantially aligned with the opening in the application surface of the dispensing tip. Some embodiments further comprise an overcap configured to selectively cover the dispensing hole. In some embodiments, the cap further comprises a plug formed therein adapted to be disposed in the opening in the application surface of the dispensing tip when the cap is engaged with the at least one of the container and the dispensing tip. In some instances, the cap comprises a cap threaded portion adapted to engage a second threaded portion provided on the at least one of the container and the dispensing tip. In some embodiments, the second threaded portion is formed on a neck on the at least one of the container or the dispensing tip. In some embodiments, the dispensing tip includes a tip thermal member and the cap includes a cap thermal member. In some instances, the tip thermal member comprises a material different from the cap thermal member.

Some embodiments provide a cosmetic applicator comprising a container containing a product to be dispensed; a dispensing tip disposed on the container, the tip comprising a tip application surface configured to contact a user's skin to apply the product to be dispensed and an opening in the application surface through which the product is to be dispensed from the reservoir; and a cap selectively engagable with at least one of the container or the dispensing tip to selectively cover the tip application surface, the cap comprising a cap application surface configured to contact a user's skin to apply the product to be dispensed. In some embodiments, the cap comprises a dispensing hole disposed therein. In some embodiments, the dispensing hole of the cap is substantially aligned with the opening in the application surface of the dispensing tip. Some embodiments further comprise an overcap configured to selectively cover the dispensing hole. In some embodiments, the cap further comprises a plug formed therein adapted to be disposed in the opening in the application surface of the dispensing tip when the cap is engaged with the at least one of the container and the dispensing tip. In some embodiments, the cap comprises a cap threaded portion adapted to engage a second threaded portion provided on the at least one of the container and the dispensing tip. In some embodiments, the second threaded portion is formed on a neck on the at least one of the container or the dispensing tip.

Some embodiments provide a cosmetic applicator comprising a dispensing portion comprising: a container containing a product to be dispensed, a tip disposed at a distal end of the container having an application surface and an opening formed through the application surface, the opening being in fluid communication with the container to dispense the product to be dispensed, and one or more dispensing portion threads; and a cap having one or more cap threads configured to cooperate with the dispensing portion threads for selective securement of the cap to the dispensing portion, wherein at least one of the dispensing portion or the cap comprises a thermal member. In some embodiments, the cap comprises a dispensing hole disposed therein. In some embodiments, the dispensing hole of the cap is substantially aligned with the opening in the application surface of the dispensing tip. In some embodiments, the thermal member comprises one or more of a ceramic, a metal, and a stone material. In some embodiments, the thermal member has a thermal conductivity of at least 1 watt/meter-kelvin. In some instances, the thermal member has a heat capacity of at most about 1.1 kilojoules/kilogram-kelvin.

Although example embodiments have been described in language specific to the structural features and/or methodological acts, the claims are not necessarily limited to the specific features or acts described. Rather, the specific features and acts are disclosed as illustrative forms of implementing the example embodiments.

What is claimed is:

1. A cosmetic applicator comprising:

a container for containing a cosmetic product to be dispensed wherein the container comprises an externally threaded neck proximate an open end of the container;

a tip comprising an application surface including a thermal member and an opening in the application surface in fluid communication with the container through which to dispense the product, and further defining an annular protrusion;

a separate skirt having internal threads for mating with the external threads of the neck, and defining an annular flange for engaging the annular protrusion of the tip to retain the tip on the neck of the container;

a cap having internal threads; and wherein the skirt is provided with external threads for threadably and selectively retaining the cap.

2. The cosmetic applicator of claim 1, wherein the thermal member comprises at least one of metal, ceramic, and a stone material.

3. The cosmetic applicator of claim 1, wherein the thermal member has a thermal conductivity of at least 1 watt/meter-kelvin.

4. The cosmetic applicator of claim 1, wherein the thermal member has a heat capacity of at most about 1.1 kilojoules/kilogram-kelvin.

5. The cosmetic applicator of claim 1, wherein the tip further comprises a sealing member contacting the container when the tip is retained on the container.

6. The cosmetic applicator of claim 1, wherein the cap further comprises a dispensing hole.

7. The cosmetic applicator of claim 6, wherein the dispensing hole in the cap aligns with the opening in the application surface.

* * * * *